US006597889B2

(12) United States Patent
Johnson et al.

(10) Patent No.: US 6,597,889 B2
(45) Date of Patent: Jul. 22, 2003

(54) DUAL PAPER PICKING MECHANISM AND METHOD FOR INCREASING SPEED AND RELIABILITY OF PAPER PATH DELIVERY

(75) Inventors: Bruce L. Johnson, Eagle, ID (US); Leonard T. Schroath, Boise, ID (US); Bradley J. Anderson, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1 day.

(21) Appl. No.: 09/912,853

(22) Filed: Jul. 24, 2001

(65) Prior Publication Data

US 2003/0021619 A1 Jan. 30, 2003

(51) Int. Cl.[7] ..... G03G 15/00
(52) U.S. Cl. ..... 399/393; 399/388
(58) Field of Search ..... 399/1, 2, 361, 399/381, 388, 393, 401, 405, 364; 347/3, 16, 104; 271/109, 114, 264

(56) References Cited

U.S. PATENT DOCUMENTS

| | | | | |
|---|---|---|---|---|
| 5,069,434 A | * | 12/1991 | Sellers | 271/109 X |
| 5,221,951 A | * | 6/1993 | Sakamoto | 399/393 |
| 5,327,207 A | * | 7/1994 | Otake et al. | 399/364 |
| 5,347,350 A | * | 9/1994 | Nakahata et al. | 399/393 X |
| 5,359,402 A | * | 10/1994 | Nakahata et al. | 399/393 X |
| 5,570,451 A | * | 10/1996 | Sakaizawa et al. | 399/2 |
| 5,729,785 A | * | 3/1998 | Sakaizawa et al. | 399/2 |

* cited by examiner

*Primary Examiner*—Sandra Brase

(57) ABSTRACT

The two paper picking rollers of a dual paper picking device independently pull sheets of paper or other print medium from a supply and feed the same to an image printing device. With the two rollers pulling sheets of paper independently, the total amount of paper moved can be doubled without the need to increase the speed of either roller. Increasing the speed of a roller or other paper picking device increases the possibility that the paper will be mishandled and jam the image-printing device.

19 Claims, 10 Drawing Sheets

DUAL PAPER PICKING MECHANISM AND METHOD FOR INCREASING SPEED AND RELIABILITY OF PAPER PATH DELIVERY

FIELD OF THE INVENTION

The present invention relates to the field of image printing devices that use paper or a similar print media to print a hardcopy from electronic data or to make a copy of an original document. More particularly, the present invention relates to a dual paper picking device that increases the speed and reliability of the stream of print media being delivered from the paper or other print media supply to the image-printing device.

BACKGROUND OF THE INVENTION

Modern computers allow users to generate virtually any kind of document the user may desire. For example, word processing software allows a user to generate and easily edit text for documents. Spreadsheet, graphic design, desktop publishing or imaging software packages allow a user to generate or manipulate graphs, pictures, images, graphics, etc. The features and abilities of computer software continually evolve to provide the computer user with the ability to manage or generate data.

Though society is moving ahead into the digital age, for many applications it is still necessary or desirable to print a hardcopy of the documents generated on a computer. Consequently, printers have evolved along with computers to output high quality renderings on paper or other print media of the documents a user has generated on a computer.

In addition to printers, photocopiers allow users to quickly reproduce a document of which multiple copies are needed. Fax machines allow users to almost instantly transmit hardcopy documents over unlimited distances. Multi-Function Peripherals ("MFPs") are devices that combine such functions as printing, copying, faxing and scanning.

As used herein, the term "image printing device" broadly denotes any device which outputs a hardcopy document on paper or some other print medium. For example, "image printing device" includes, but is not limited to, printers, photocopiers, fax machines, plotters, digital copiers and MFPs. The term "printer" refers broadly to any device that receives electrical data from a computer and outputs a hardcopy document corresponding to that data. Thus, "printer" refers, but is not limited to, electrostatic or laser printers, inkjet printers, thermal transfer printers, dot-matrix printers, plotters, etc.

All image-printing devices are fed a supply of a print medium, typically paper, on which the hardcopy document being output is rendered. While paper is the most widely used print medium, modern image printing devices can utilize a wide variety of print media including, but not limited to, paper, cardstock, transparencies, labels, etc. As used hereafter, the term "paper" shall be understood to refer principally to paper, but it will be understood that whenever an image-printing device is using paper as the print medium, any other print medium could also be used, consistent with any constraints imposed by the particular image-printing device in question.

For most image printing devices, regardless of the type of device, the modern trend is to adapt the image-printing device to accept and use a standard size of paper, for example, 8.5 inch by 11 inch paper or A4 paper. With all image-printing devices in an office using the same type of paper, the task of supplying the devices with paper is greatly simplified.

Additionally, the output speed and reliability of an image-printing device is heavily dependent on the ability of the device to feed itself the paper or other print medium used. For example, a printer cannot output printed pages any faster than it can pull in and position the paper to be printed on. Similarly, if the paper is mishandled, the printer will jam and stop, thereby causing further delays in the printing process. Consequently, the system for feeding paper or other print medium into an image-printing device is very important and critical to the speed and reliability of the device.

Unfortunately, there is often a trade off between speed and reliability in an image-printing device. For example, the faster the paper-feeding mechanism pulls sheets from a paper supply, the more likely it becomes that the fast moving paper will be mishandled and jam the image printing device. If the paper-feeding mechanism pulls sheets more slowly, the sheets are less likely to be mishandled, but the output speed of the image-printing device is correspondingly reduced.

Consequently, there is a need in the art for a device and method of increasing the ability of a paper-feeding mechanism to supply paper or another print medium to an image printing device at a high rate of speed without increasing the likelihood of mishandling the paper or other print medium and causing a printer error or paper jam.

SUMMARY OF THE INVENTION

The present invention is directed to a dual print medium picking mechanism for feeding print media from a supply of a print medium to an image-printing device. Specifically, the mechanism preferably includes a first print medium picking device for feeding print media from the supply to the image printing device; and a second print medium picking device for feeding print media from the supply to the image printing device.

The device of the present invention may include a single print medium transport path into which sheets of print medium are fed by both the first and second print medium picking devices. Alternatively, the device may include a first print medium transport path into which sheets of print medium are fed by the first print medium picking device; and a second print medium transport path into which sheets of print medium are fed by the second print medium picking device.

The present invention also encompasses the methods of making and using the dual print medium picking mechanism and image printing device described above. For example, the present invention includes a method of printing documents with an image printing device having a dual print medium picking mechanism, where the dual print medium picking mechanism includes a first print medium picking device for feeding print media from the supply to the image printing device; and a second print medium picking device for feeding print media from the supply to the image printing device. The method of the present invention is then performed by alternately picking sheets of print media from the supply with the first and second print medium picking devices and feeding the sheets of print media through the image printing device.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Throughout the drawings, identical elements are designated by identical reference numbers.

DETAILED DESCRIPTION OF THE PREFERRED EMBODIMENTS

In the preferred embodiment, the present invention may be embodied in a dual paper picking device that has two independent means of pulling sheets of paper or other print medium from a supply and feeding the same to an image printing device. With two paper picking means operating independently, the total amount of paper pulled by the paper picking device can be doubled without requiring components of the paper picking device to move the paper more quickly. When the paper-picking device is made to move more quickly, the probability that the paper or other print medium will be mishandled and jam the image-printing device is correspondingly increased.

Figure 1:
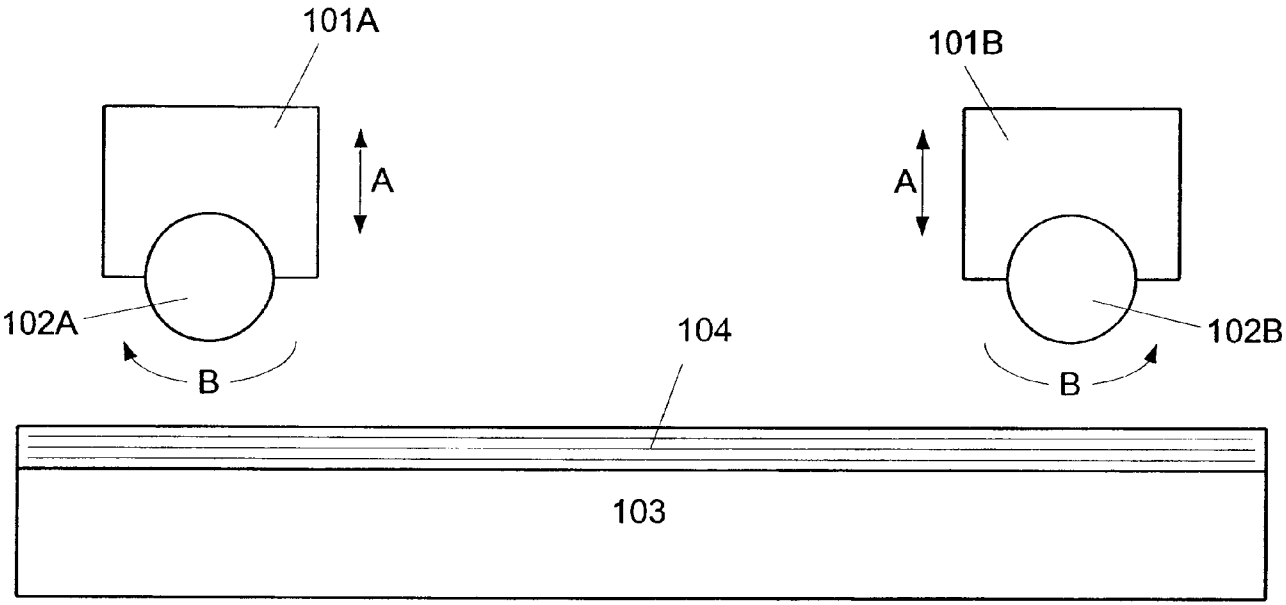
FIG. 1 is an illustration of a dual paper-picking device according to the principles of the present invention.

Using the drawings, the preferred embodiments of the present invention will now be explained. FIG. 1 illustrates a preferred embodiment of the present invention in which the paper picking mechanism for an image-printing device includes two rollers (102A, 102B). Each roller (102) is a disk or wheel, preferably made of a high-friction material, such as rubber.

In principle, a roller (e.g., 102) functions as a paper-picking device in the following manner. When a sheet of paper or other print medium is to be pulled from a supply of print medium, the roller is driven to rotate about a central axis, the roller is then brought into contact with the next sheet of paper or other print medium in the supply. As the roller rotates, the roller does not slide over the surface of the paper, but rather the sheet of paper is driven into a paper transport path of the image-printing device.

Consistent with this explanation, each of the rollers (102A, 102B) illustrated in FIG. 1 is rotatably mounted on a driver (101A, 101B). The drivers (101) rotate the rollers as needed. Each driver (101) also independently moves up and down as illustrated by the arrows (A) in FIG. 1. This motion brings the driven rollers (102) into and out of contact with a supply of paper (104) or other print medium. The paper (104) or other print medium is stored in a supply tray (103).

As shown in FIG. 1, the rollers (102) are driven in opposite directions. The roller on the left (102A) is driven clockwise as indicated by the arrow (B). The roller on the right (102B) is driven counter-clockwise as indicated by the arrow (B). Consequently, each roller (102) pushes the sheet of paper it may be in contact with in a different direction. The roller on the left (102A) will move sheets of paper (104) out of the tray (103) to the left. The roller on the right (102B) will move sheets of paper (104) out of the tray (103) to the right.

Figure 2:
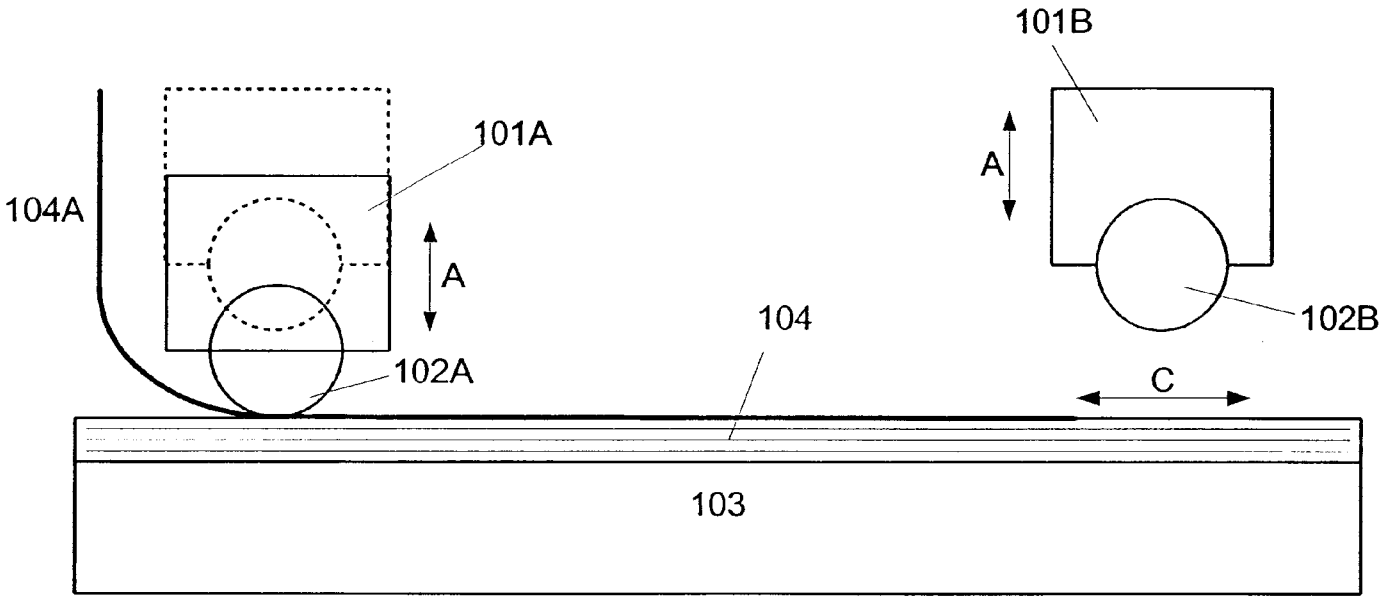
FIG. 2 is an illustration of the dual paper-picking device of FIG. 1 in a first stage of operation.

Beginning with FIG. 2, an example of an operating method of the dual paper picking mechanism of FIG. 1 will be explained. As shown in FIG. 2, one of the rollers (102), in this example, the roller to the left (102A), is driven and lowered or otherwise brought into contact with the paper supply (104). The top sheet of paper or other print medium in the supply (104), in this case sheet (104A), is then pushed by the rotating roller (102A) out of the supply tray (103) and into a paper transport path as shown in FIG. 2. In this way, roller (102A) picks sheets from the supply (104) and feeds the paper transport path of the image-printing device.

Initially, before it is moved by the roller (102A), the right end of the top sheet (104A) extends under the second roller (102B). At this point in the cycle, the second roller (102B), illustrated to the right of FIG. 2, is raised and not in contact with the paper supply (104). However, as soon as the top sheet (104A) has been moved by the left roller (102A) so that the top sheet (104A) no longer extends into the space (C) under the right roller (102B), the right roller (102B) can be lowered to contact and begin moving the next sheet down in the stack (104). Consequently, sheets can be removed from the stack (104) more quickly because the second roller (102B) need not wait until the first roller (102A) has completely removed the top sheet (104A) from the stack (104) before contacting and beginning to move the next sheet down in the stack (104).

Figure 3:
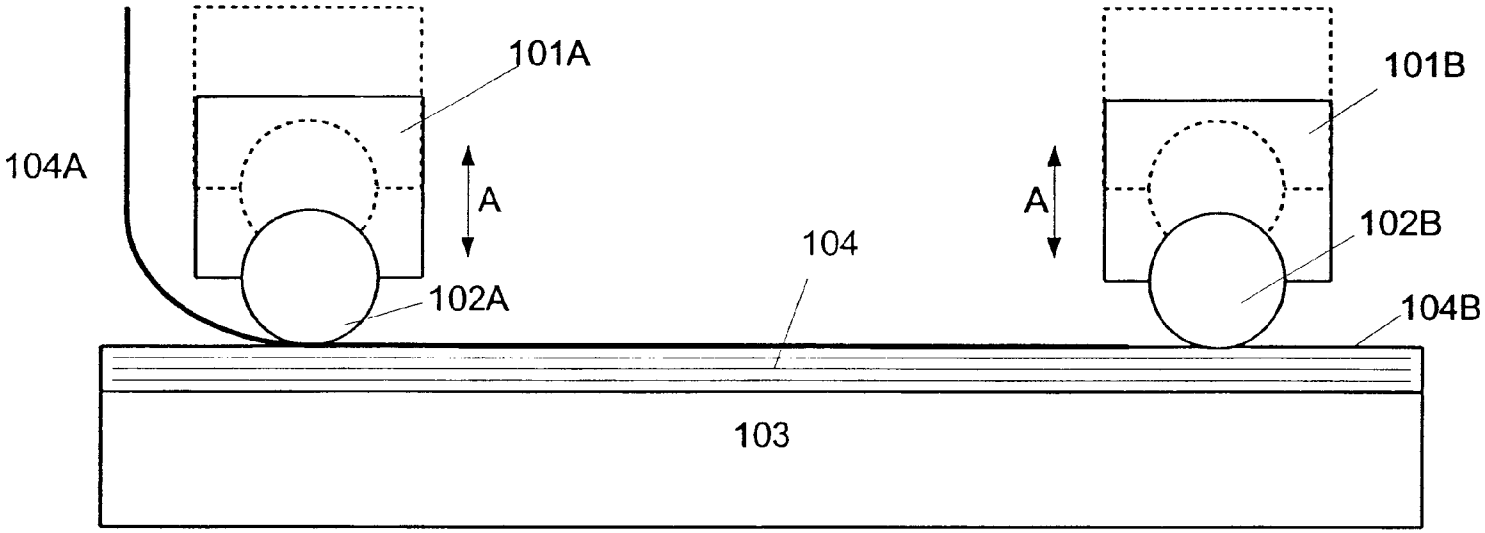
FIG. 3 is an illustration of the dual paper-picking device of FIG. 1 in a second stage of operation.

FIG. 3 continues the illustration of an exemplary method of operating the dual paper picking mechanism of FIG. 1. As shown in FIG. 3, and as described above, when the top sheet (104A) of paper or other print medium has been moved by the first or left roller (102A) out from under the second or right roller (102B), the second roller (102B) is lowered or otherwise brought into contact with the stack or supply of paper (104) or other print medium and can begin then to feed the next sheet (104B) in the stack (104) into a paper transport path of the image printing device.

As noted above, there is often a trade off in the mechanism that feeds paper or another print medium to an image-printing device. If the mechanism attempts to move and feed the paper quickly, the probability that the paper will be mishandled and jam the image-printing device is correspondingly increased. Alternatively, if the paper or other print medium is moved and fed more slowly, there is less chance of a misfeed, but the output of the image-printing device is correspondingly slowed.

With the present invention, this trade off can be avoided. With the dual paper picking mechanism, each paper picking mechanism, such as a driven roller, can move or feed sheets at a relatively low speed decreasing the probability of mishandling and a consequent jam. However, because two picking mechanisms are feeding sheets to the image printing device, the overall output speed of the image printing device can be increased, perhaps doubled.

For example, the paper or other print medium pick rate using the present invention can be expressed as follows: $R=2V/l$ where R is the pick rate (pages/second); V is the velocity of the paper or other print medium and l is the length of the paper or other print medium. This equation assumes that the two rollers will alternately feed sheets from the print medium supply.

Additionally, some high volume image printing devices use a vacuum system as part of the paper picking mechanism. The vacuum system enhances the ability of the mechanism to reliably handle sheets of paper or other print medium. However, the vacuum system also adds cost to the printing device. With the present invention, the use of a vacuum system in the paper picking mechanism could be avoided.

Figure 4:
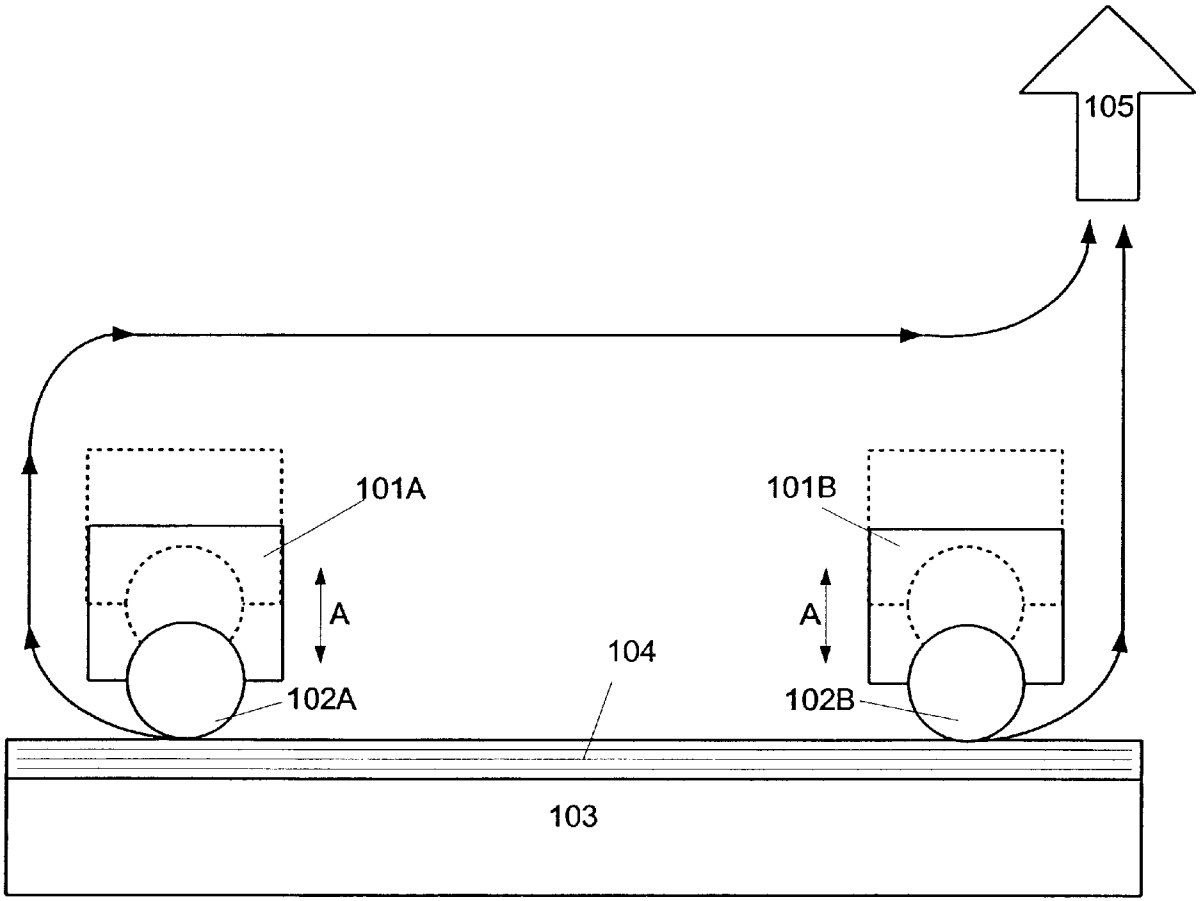
FIG. 4 is an illustration of the dual paper-picking device of FIG. 1 feeding a single paper path.

FIG. 4 illustrates a first embodiment of the present invention in which each of the two rollers (102) of the dual paper picking mechanism are both feeding a single paper transport path (105). As used herein "paper transport path" refers to a path that includes rollers or other means for moving a piece of paper or other print medium along a predefined path within the image-printing device.

The paper transport path (105) takes the sheets of paper or other print medium to the print engine of the image-printing device. As indicated above the "image printing device" may be any device which outputs a hardcopy document on paper or some other print medium, for example, an electrostatic or laser printer, an inkjet printer, a thermal transfer printer, a dot-matrix printer, a plotter, a photocopier, a fax machine, a digital copier or an MFPs. The type of print engine to which the paper transport path (105) feeds sheets of print medium will depend on the type of image printing device it is. However, the dual paper picking mechanism of the present invention may be profitably implemented in the image-printing device regardless of the type.

As shown in FIG. 4, the paper transport path (105) may be located above the right roller (102B). Consequently, the right roller (102B) feeds sheets of print medium directly up into the paper transport path (105). The left roller (102A), however, feeds paper into a transport path that brings the paper across the machine and into the paper transport path (105). This is merely an exemplary embodiment. The paper transport path (105) may be differently oriented consistent with the principles of the present invention.

Figure 5:
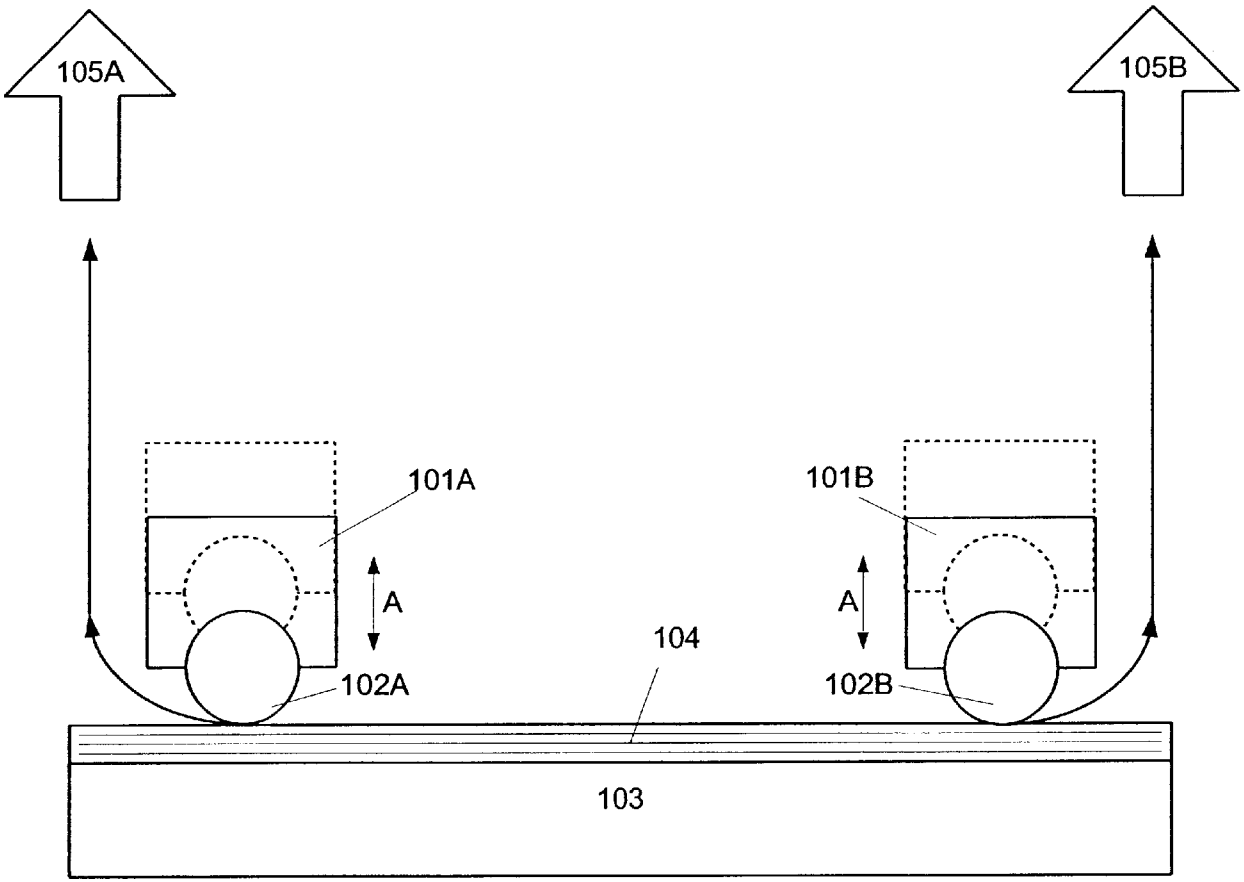
FIG. 5 is an illustration of the dual paper-picking device of FIG. 1 feeding two separate paper paths enabling parallel printing.

While FIG. 4 illustrates the dual paper picking mechanism of the present invention feeding a single paper transport path, it is also possible for each of the paper picking mechanisms to feed a separate paper transport path. FIG. 5 illustrates a second embodiment of the present invention in which two separate paper transport paths are fed by the dual paper picking mechanism. As shown in FIG. 5, the left roller (102A) feeds a first paper transport path (105A). Preferably, the first paper transport path (105A) is located immediately above the roller (102A) so as to conveniently receive sheets of paper or other print medium from that roller (102A).

The right roller (102B) feeds a second paper transport path (105B). Again, the second paper transport path (105B) is preferably located immediately above or adjacent the right roller (102B) so as to conveniently receive sheets of paper or other print medium from that roller (102B).

With the dual paper picking mechanism of the present invention, the speed and reliability with which sheets of print medium can be provided to the print engine of an image-printing device are greatly increased. Consequently, it may then become the speed of the print engine, rather than the speed of the paper flow, that is the bottleneck restricting the overall output rate of the image printing device.

Where this is the case, the two separate paper paths (105A, 105B) illustrated in FIG. 5 can be associated with independent print engines to allow for faster output using a parallel printing or copying process. This embodiment of the present invention is illustrated in FIG. 6.

Figure 6:
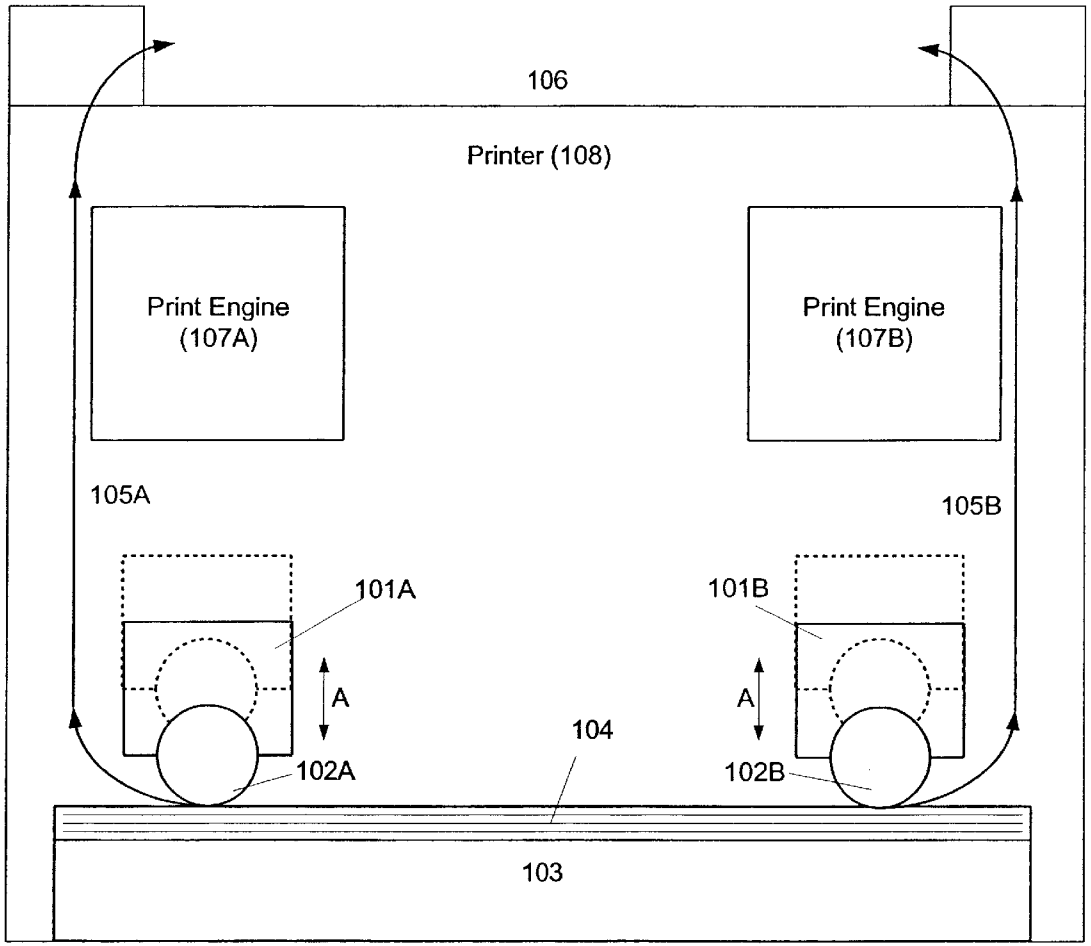
FIG. 6 is an illustration of an image-printing device incorporating the dual paper-picking device of FIG. 5.

FIG. 6 illustrates an image-printing device embodied according to the principles of the present invention. The image-printing device (108) illustrated in FIG. 6 is a printer. However, it will be understood by those skilled in the art that the principles illustrated in FIG. 6 could be readily adapted for use in any other type of image printing device including a fax machine, photocopier, MFP, etc.

As shown in FIG. 6, the printer (108) may include two independent paper transport paths (105A, 105B) that are each associated with a separate print engine (107A, 107B). As indicated above, the type of print engine will be determined by the type of image printing device. In the printer (108) of exemplary FIG. 6, the print engines (107A, 107B) may be electrostatic or laser print engines, inkjet print engines, thermal transfer print engines, dot matrix print engines, etc.

In fact, it is not necessary that both print engines (107A, 107B) be of the same type. Rather, the image-printing device (108) may incorporate two different types of print engines on parallel paper transport paths.

With dual print engines (107) being fed by two independent paper transport paths (105A, 105B), the image-printing device (108) can execute a print job using a parallel printing process. For example, a first page of the print job is printed on paper in the left transport path (105A) by the left print engine (107A). The second page is printed on paper in the right transport path (105B) by the right print engine (107B). In this way, the overall speed with which the print job is executed is dramatically increased.

An output tray or area (106) of the image-printing device (108) can be fed with the output of both print engines (107). Pages from the two print engines (107) are interleaved in the output tray (106) so that the pages are collated into the order specified by the print job.

Figure 7:
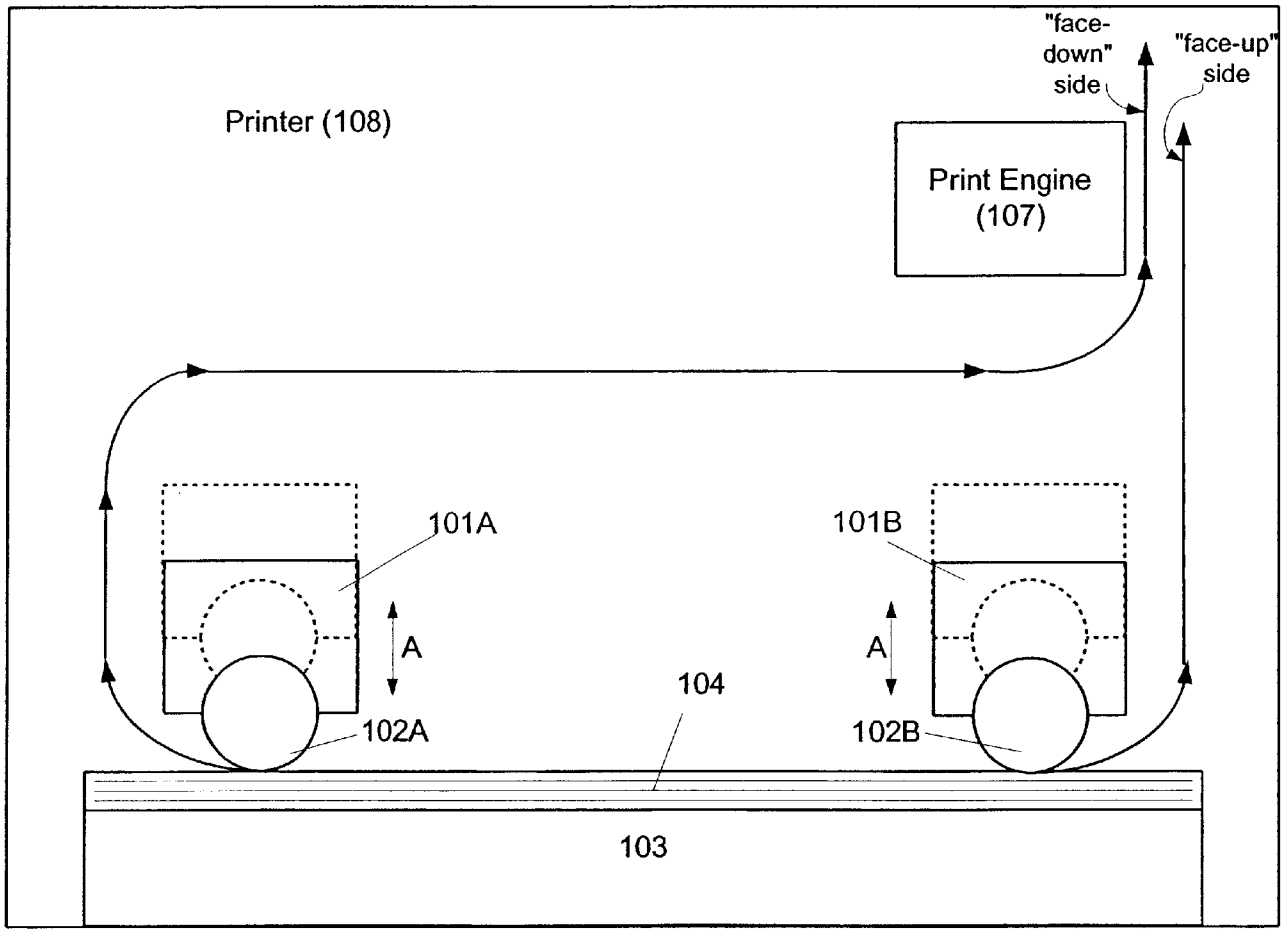
FIG. 7 is an illustration of an image-printing device incorporating the dual paper-picking device of FIG. 4.

FIG. 7 illustrates an image-printing device that builds on the dual paper picking mechanism of FIG. 4 in which both rollers (102A, 102B) feed the same paper transport path (105). As shown in FIG. 7, the print engine (107) will naturally be presented with different sides of the paper (104) or other print medium depending on which roller (102A, 102B) pulled the sheet from the supply (104). Thus, if it is important to print on one side or the other of the print medium, this can be accomplished by selecting the roller (102) that pulls the sheet of print medium from the supply (104).

As shown in FIG. 7, the print engine (107) will print on the facedown side (relative to the position of the paper in the supply tray (103)) if the sheet was fed by the left roller (102A). Alternatively, the print engine (107) will print on the face-up side of the paper if the sheet was feed by the right roller (102B). Thus, if it is important to print on one side or the other of the print medium, this can be accomplished by selecting the roller (102) that pulls the sheet of print medium from the supply (104).

In this regard, the present invention has a particularly useful application if the user wishes to print a combination of duplex and simplex jobs on an asymmetric medium. A simplex job is a print job where only one side of the print medium is used for printing. In contrast, duplex printing involves printing on both sides of the print medium. An asymmetric print medium is a medium that has a particular feature that is not symmetrical. Examples of asymmetric print media include printed letterhead, three-hole punched paper, etc.

Figure 8A:
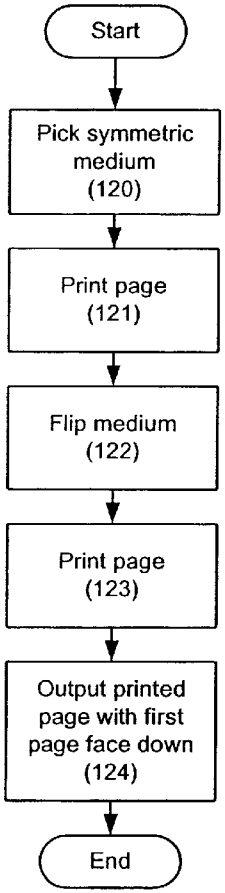
FIGS. 8*a*, 8*b* and 8*c* are flowcharts illustrating a particular application of the present invention to the problem of duplex printing on an asymmetric print medium
Figure 8B:
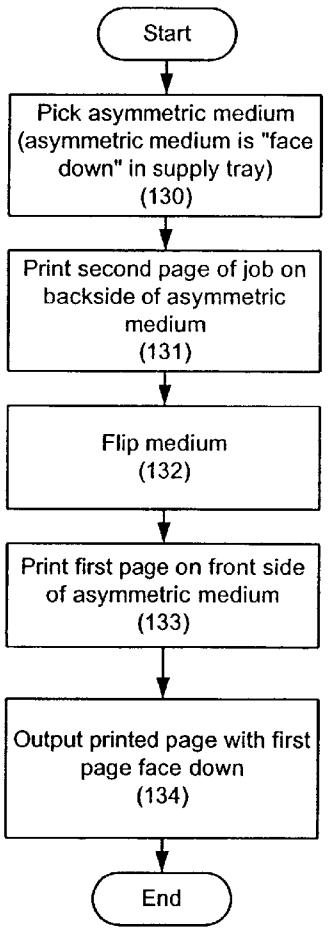
Figure 8C:
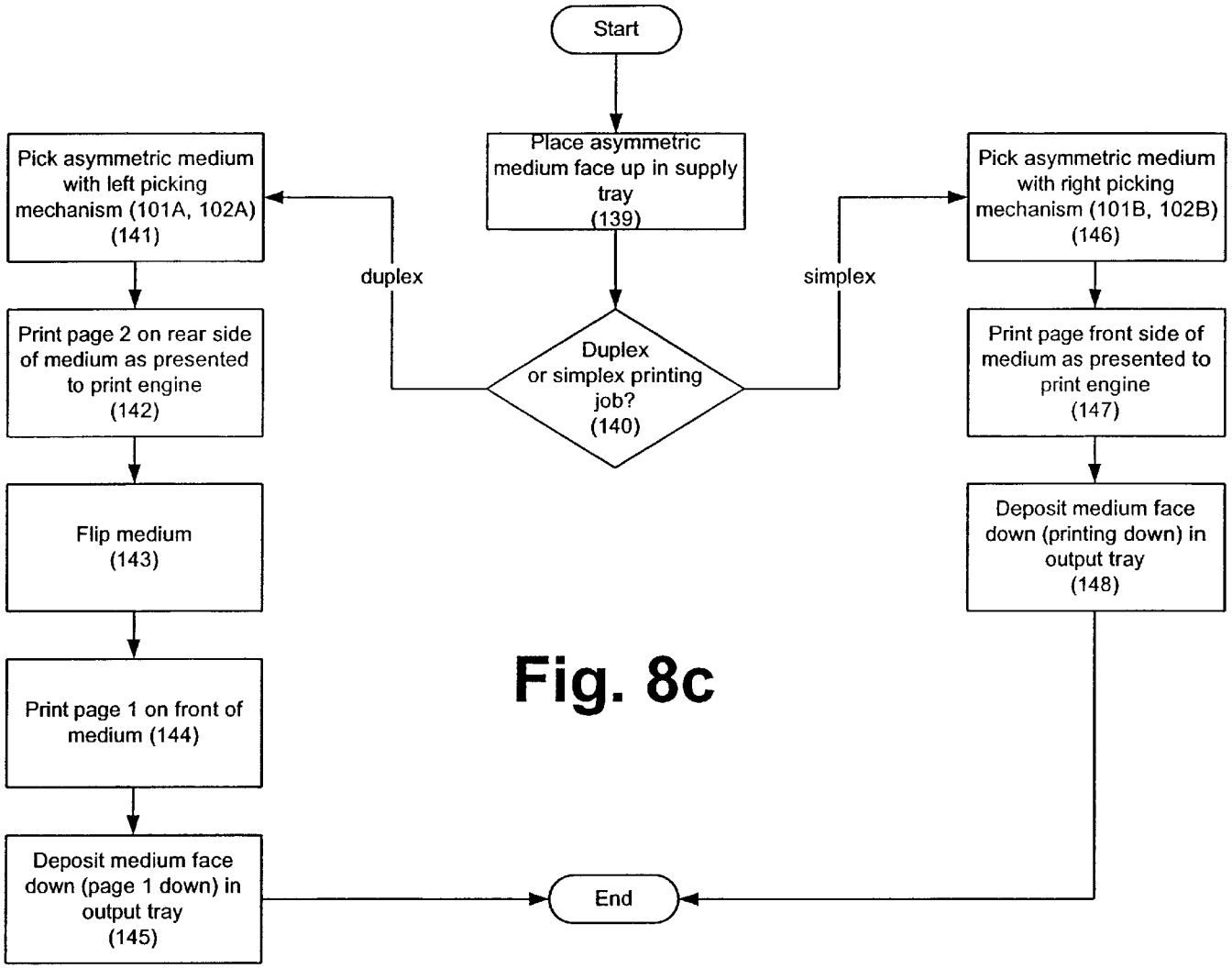
Figure 9:
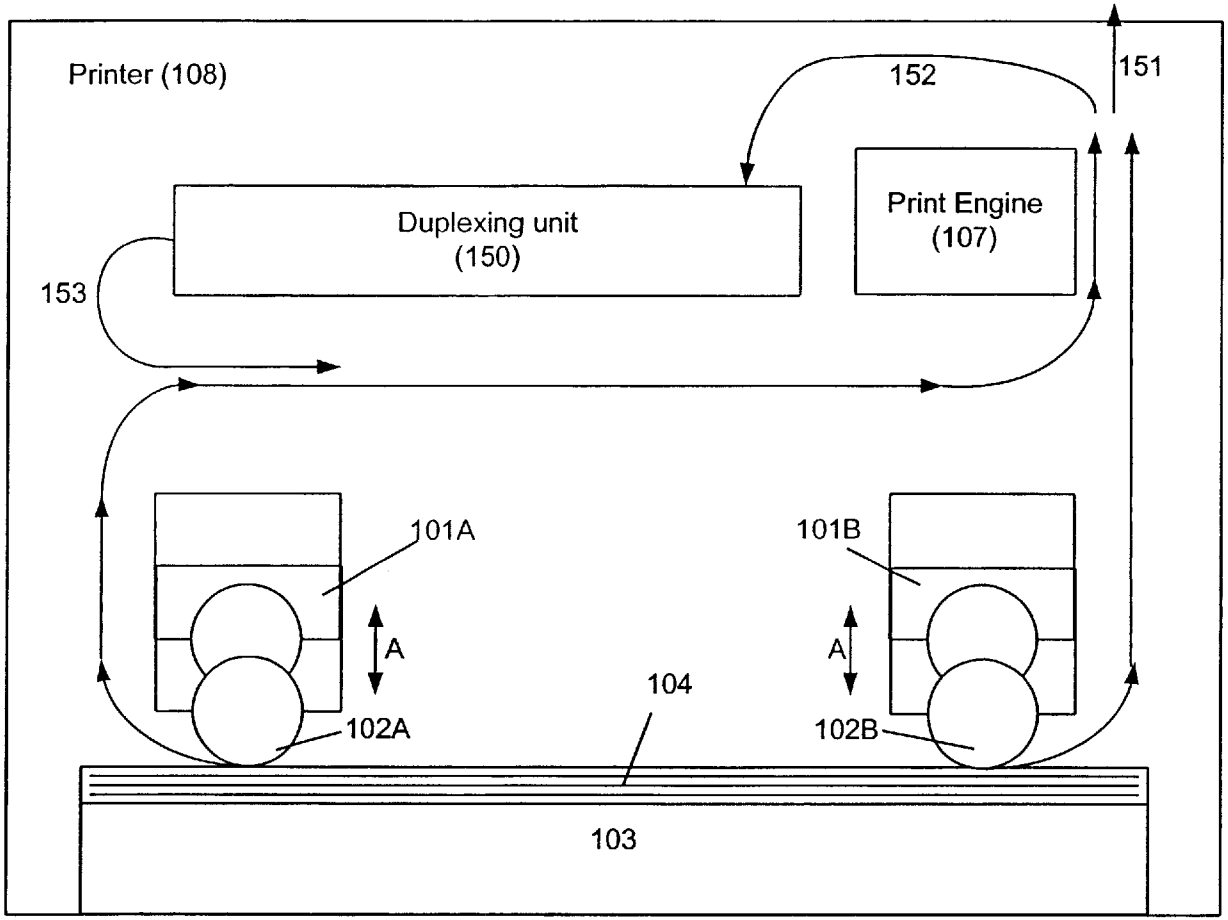
FIG. 9 is an illustration of an image-printing device incorporating the dual paper-picking device of the present invention along with a duplexing unit.

As will be illustrated in FIGS. 8 and 9, the present invention can be extremely useful in an image-printing device that handles both duplex and simplex print jobs on an asymmetric medium. For simplicity, the example illustrated in FIGS. 8 and 9 is that of a printer that is used to print duplex and simplex jobs on letterhead. However, it will be readily understood from this specification by those skilled in the art that the present invention can be applied to any image printing device and asymmetric medium to solve the problems of printing both simplex and duplex jobs on asymmetric print media.

FIG. 8*a* illustrates duplex printing with a symmetric print medium. If the print medium is symmetric, the face-up and facedown sides of the paper (as the paper sits in the paper tray) are identical and it does not matter which side becomes the side that is printed as page 1 of the print job. Thus, as shown in FIG. 8*a*, a sheet of paper or print medium is picked (120). One side is printed (121), the medium is flipped (122) by a duplexing unit and the second side is printed (123). The sheet, having been printed on both sides, is then output (124).

Most printers are designed to output sheets with the most recently printed side facing down. This allows the print job to be automatically collated with the printed pages in the proper order when the job is retrieved from the printer.

As seen in FIG. 8*a*, duplex printing on a symmetric print medium is a relatively simple and straightforward process. FIG. 8*b* illustrates the complexities introduced when an asymmetric print medium, such as letterhead is used. With an asymmetric print medium, it now becomes important that the first page of the print job be printed on a particular side of the asymmetric print medium.

As shown in FIG. 8*b*, for a duplex job, the letterhead is usually pre-flipped by the user, i.e., placed in the paper tray with the printed letterhead side face down. This is the position of the letterhead when picked for a print job (130). Because the letterhead has placed face down in the paper tray, the back of the letterhead is presented to the print engine first. The print engine, controlled by firmware and a print driver that are created to handle duplex printing, prints page 2 of the print job on the "back" of the letterhead (131). The letterhead is then flipped (132) and page 1 of the print job is printed on the "front" of the letterhead (133). The printed page is then output with the page 1 of the print job on the "front" of the letterhead being deposited face down so as to collate the print job (134).

The problem here arises if the next print job on the letterhead is a simplex print job. If it is, when the first sheet of letterhead is picked, the "back" of the letterhead will be presented to the print engine as described above, because the letterhead is placed face-down in the paper tray by the user for duplex printing. However, in a simplex print job, the "back" side of the print medium is not printed on. Consequently, the user will have to access the paper tray and flip the letterhead supply each time a switch is made between a simplex and a duplex print job.

The present invention solves this problem. Because the dual paper picking mechanism of the present invention can effectively select which side of the print medium is first presented to the print engine, as illustrated above in FIG. 7, the dual paper picking mechanism of the present invention can be used to correctly pull a sheet of asymmetric print medium so as to first present the "back" side to the print engine for a duplex print job or the "front" side for a simplex print job.

As shown in FIG. 8*c*, the asymmetric print medium can be placed "face-up" in the supply tray (139) and need not be "pre-flipped" by the user, i.e., placed "facedown," in anticipation of a duplex print job. Next, the printer firmware determines if the print job on the asymmetric medium is a duplex or simplex print job (140).

If the job is a simplex job, referring also to FIG. 9, a sheet of print medium is picked (146) using the paper-picking device (101B, 102B) on the right. This automatically presents the front or top side of the asymmetric medium to the print engine (107). The first page of the print job is then properly printed (147) on the front of the asymmetric print medium. The printed page can then be output through paper path (151) and deposited "printing down" for automatic collation of the print job (148).

If the print job is a duplex job, referring again to both FIGS. 8*c* and 9, a sheet of asymmetric print medium is picked with (141) using the paper-picking device (101A, 102A) on the left. This effectively flips the print medium as described above so that the "back" or underside of the asymmetric print medium (e.g., letterhead) is presented to the print engine (107). Page 2 of the print job is then printed first on the back side of the print medium (142).

The print medium is then routed to a duplexing unit (150) by a paper transport path (152). The duplexing unit (150) flips the paper (143) and reintroduces the reoriented paper into a transport path back to the print engine (107). Having been flipped by the duplexing unit (150), the front of the asymmetric medium is now presented to the print engine (107) and the first page of the print job is printed (144). The asymmetric medium, having now been printed on both sides, is output through paper path (151) and deposited with the first page of the print job facing down (145) for automatic collation of the print job.

In rapid duplex printers, the process becomes more complex. For example, the printer may print page 2 of the print job on a first sheet. Then print page 4 on a second sheet while the first sheet is flipped and routed back for the printing of page 1 on the front of the first sheet. The present invention as described herein can be readily applied to such high-speed duplex printers as will be apparent to those skilled in the art from the explanation given herein.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A dual print medium picking mechanism for feeding print media from a supply of a print medium to an image printing device, said mechanism comprising:

a first print medium picking device for feeding print media from a stack of print medium to said image printing device; and a second print medium picking device for feeding print media from said same stack of print medium to said image printing device.

2. The dual print medium picking mechanism of claim 1, further comprising a single print medium transport path into which sheets of print medium are fed by both said first and second print medium picking devices.

3. The dual print medium picking mechanism of claim 1, further comprising:

a first print medium transport path into which sheets of print medium are fed by said first print medium picking device; and a second print medium transport path into which sheets of print medium are fed by said second print medium picking device.

4. The dual print medium picking mechanism of claim 1, wherein said first and second print medium picking devices each comprise a driven roller which is selectively brought into contact with said supply of print medium.

5. A dual print medium picking mechanism for feeding print media from a supply of a print medium to an image printing device, said mechanism comprising:

a first print medium picking device for feeding print media from said supply to said image printing device; and a second print medium picking device for feeding print media from said supply to said image printing device;

wherein said first and second print medium picking devices each comprise a driven roller which is selectively brought into contact with said supply of print medium;

wherein said roller of said second print medium picking device is brought into contact with said supply of print medium when said roller of said first print medium picking device has moved a top sheet of said print medium supply sufficiently to expose a next sheet of said print medium supply to said roller of said second print medium picking device without waiting for said top sheet to be completely removed from said supply of print medium.

6. A print medium handling system feeding print media from a supply of a print medium to an image printing device, said system comprising:

said supply of print medium, said supply of print medium being a single stack of a print medium disposed at a single location;

a first print medium picking device for feeding print media from said supply to said image printing device;

a second print medium picking device for feeding print media from said supply to said image-printing device;

a first print medium transport path into which sheets of print medium are fed by said first print medium picking device; and a second print medium transport path into which sheets of print medium are fed by said second print medium picking device.

7. The dual print medium picking mechanism of claim 6, further comprising:

a first print engine that receives print medium from said first print medium transport path and prints images thereon; and a second print engine that receives print medium from said second print medium transport path and prints images thereon.

8. The dual print medium picking mechanism of claim 7, wherein said first and second print engines are of different types.

9. The dual print medium picking mechanism of claim 7, wherein printed sheets from both said first and second print medium transport paths are interleaved in an output area so as to collate a print job being printed.

10. A method of printing documents with an image-printing device having a dual print medium picking mechanism, wherein said dual print medium picking mechanism comprises a first print medium picking device for feeding print media from a supply of print media to said image printing device; and a second print medium picking device for feeding print media from said supply to said image-printing device;

said method comprising alternately picking sheets of print media from said supply with said first and second print medium picking devices and feeding said sheets of print media through said image printing device.

11. The method of claim 10, wherein said first and second print medium picking devices each comprise a roller and said method further comprises:

selectively bringing rollers of said first and second print medium picking device into contact with said supply of print medium; and driving said rollers to feed sheets of said print medium when the roller is in contact with said supply of print medium.

12. The method of claim 11, further comprising bringing said roller of said second print medium picking device into contact with said supply of print medium when said roller of said first print medium picking device has moved a top sheet of said print medium supply sufficiently to expose a next sheet of said print medium supply to said roller of said second print medium picking device without waiting for said top sheet to be completely removed from said supply of print medium.

13. The method of claim 10, further comprising feeding a single print medium transport path with sheets of print medium from both said first and second print medium picking devices.

14. The method of claim 10, further comprising:

feeding a first print medium transport path with sheets of print medium fed by said first print medium picking device; and feeding a second print medium transport path with sheets of print medium fed by said second print medium picking device.

15. The method of claim 14, further comprising:

printing images on sheets of said print medium in said first print medium transport path with a first print engine; and printing images on sheets of said print medium in said second print medium transport path with a second print engine.

16. An image printing device having a dual print medium picking mechanism for feeding print media from a supply of a print medium to said image printing device, said dual print medium picking mechanism comprising:

a supply of a print medium comprising a stack of said print medium;

a first means for feeding print media from said stack to said image printing device; and a second means for feeding print media from said same stack to said image printing device.

17. The image printing device of claim 16, further comprising a single print medium transport means into which sheets of print medium are fed by both said first and second print medium feeding means.

18. The image-printing device of claim 16, further comprising:

a first print medium transport means into which sheets of print medium are fed by said first print medium feeding means; and a second print medium transport means into which sheets of print medium are fed by said second print medium feeding means.

19. A print medium handling system for feeding print media from a supply of a print medium to an image printing device, said system comprising:

a first print medium picking device for feeding print media of a particular size from said supply to said image printing device;

a second print medium picking device for feeding print media of said particular size from said supply to said image-printing device; and a single print medium transport path into which sheets of print medium are fed by both said first and second print medium picking devices;

wherein a print engine of said image printing device receives print medium from said single print medium transport path and prints images thereon, said print medium is asymmetrical, and a sheet of print medium is fed from said supply by said first print medium picking device or said second print medium picking device depending on whether a print job being performed is a simplex print job or a duplex print job.

* * * * *